US011114115B2

(12) United States Patent
Gupta

(10) Patent No.: US 11,114,115 B2
(45) Date of Patent: Sep. 7, 2021

(54) MICROPHONE OPERATIONS BASED ON VOICE CHARACTERISTICS

(71) Applicant: HEWLETT-PACKARD DEVELOPMENT COMPANY, L.P., Houston, TX (US)

(72) Inventor: Mohit Gupta, San Diego, CA (US)

(73) Assignee: Hewlett-Packard Deveopment Company, L.P., Spring, TX (US)

( * ) Notice: Subject to any disclaimer, the term of this patent is extended or adjusted under 35 U.S.C. 154(b) by 606 days.

(21) Appl. No.: 16/075,612

(22) PCT Filed: Feb. 15, 2017

(86) PCT No.: PCT/US2017/017914
§ 371 (c)(1),
(2) Date: Aug. 4, 2018

(87) PCT Pub. No.: WO2018/151717
PCT Pub. Date: Aug. 23, 2018

(65) Prior Publication Data
US 2021/0210116 A1 Jul. 8, 2021

(51) Int. Cl.
*G10L 25/78* (2013.01)
*H04R 3/00* (2006.01)

(52) U.S. Cl.
CPC ..... *G10L 25/78* (2013.01); *H04R 3/005* (2013.01); *G10L 2025/783* (2013.01); *H04R 2430/01* (2013.01)

(58) Field of Classification Search
CPC ..... H04R 3/005; H04R 2430/01; G10L 15/22; G10L 15/08; G10L 25/78; G10L 2015/223; G10L 2015/226; G10L 2015/088; G10L 2025/783; G06F 3/167; H04M 3/2236
See application file for complete search history.

(56) References Cited

U.S. PATENT DOCUMENTS

| | | | | |
|---|---|---|---|---|
| 9,215,543 | B2 | 12/2015 | Sun et al. | |
| 9,319,513 | B2 | 4/2016 | Guo et al. | |
| 9,386,147 | B2 | 7/2016 | Mcdysan et al. | |
| 9,392,088 | B2 | 7/2016 | Strazisar et al. | |
| 2013/0090922 | A1* | 4/2013 | Lim | H04M 3/2236 704/225 |
| 2014/0379351 | A1 | 12/2014 | Raniwala | |
| 2016/0351191 | A1* | 12/2016 | Vilermo | G10L 15/22 |

FOREIGN PATENT DOCUMENTS

| | | | |
|---|---|---|---|
| CN | 205647544 U | * | 10/2016 |
| CN | 205647544 U | | 10/2016 |

OTHER PUBLICATIONS

Kenney, "Google+ Hangout Will Now Mute Your MIC While You Type, Helps Saves Eardrums", Retrieved from Internet: https://dottech.org/105255/google-hangout-will-now-mute-your-mic-while-you-type-helps-saves-eardrums/, Apr. 18, 2013, 4 pages.

* cited by examiner

*Primary Examiner* — Yogeshkumar Patel
(74) *Attorney, Agent, or Firm* — HPI Patent Department

(57) ABSTRACT

In an example implementation according to aspects of the present disclosure, a method may include identifying, via a first microphone of a device, when a user registered to use the device is speaking, and comparing a voice characteristic of the user, as detected by the first microphone, against a threshold value. If the voice characteristic exceeds the threshold value, the method may include unmuting a second microphone of the device for the user to participate in a teleconference.

13 Claims, 3 Drawing Sheets

MICROPHONE OPERATIONS BASED ON VOICE CHARACTERISTICS

BACKGROUND

Collaborative communication between different parties is an important part of today's world. People meet with each other on a daily basis by necessity and by choice, formally and informally, in person and remotely. There are different kinds of meetings that can have very different characteristics. As an example, when a meeting is held in a conference room, a number of participants may not be able to physically attend. Collaborative workspaces are inter-connected environments in which participants in dispersed locations can interact with participants in the conference room. In any meeting, an effective communication between the different parties is one of the main keys for a successful meeting.

DETAILED DESCRIPTION

Communication technologies, both wireless and wired, have seen dramatic improvements over the past years. A large number of the people who participate in meetings today carry at least one mobile device, where the device is equipped with a diverse set of communication or radio interfaces. Through these interfaces, the mobile device can establish communications with the devices of other users, a central processing system, reach the Internet, or access various data services through wireless or wired networks. With regards to teleconferences, where some users may be gathered in a conference room for the teleconference, and other users may be logged into the teleconference from remote locations, each user, whether local or remote, may be logged into the teleconference from their respective devices. Issues may arise when a user may have their device muted or unmuted while they desire to be heard or not heard, respectively.

Examples disclosed herein provide the ability to automatically mute or unmute a user's device while the user is participating in a teleconference, based on whether the user intends to be heard on the teleconference. For example, if the user is participating in the teleconference where there is background noise or a noisy environment, the device may be automatically muted when the user is not speaking. Similarly, if the user is having a side conversation while on the teleconference, the device may be automatically muted in order to avoid the side conversation from being heard on the teleconference. As another example, if the device is muted while on the teleconference, the device may then be automatically unmuted when the user begins to speak into their device. As will be further described, a combination of microphones associated with the device may be used for automatically muting/unmuting the device from participating in the teleconference, based on voice characteristics of the user.

Figure 1:
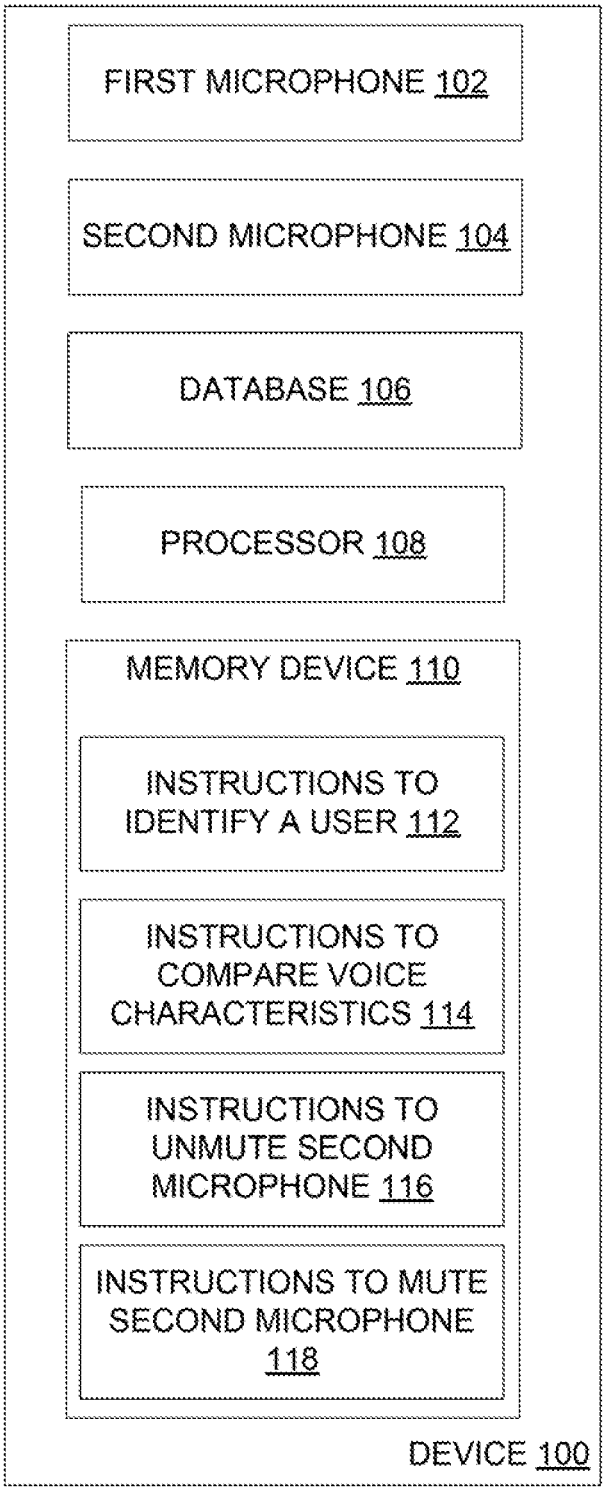
FIG. 1 illustrates a device that includes multiple microphones for determining whether a user of the device should be muted or unmuted from participating in a teleconference, according to an example.

With reference to the figures, FIG. 1 illustrates a device 100 that includes multiple microphones for determining whether a user of the device 100 should be muted or unmuted from participating in a teleconference, according to an example. As an example, the device 100 may correspond to a portable computing device, such as a smartphone or a notebook computer, with a first microphone 102 and a second microphone 104 associated with the device 100. As an example, the microphones 102, 104 may be internal to the device 100, external to the device 100, such as a Bluetooth headset, or a combination of both. As will be further described, one of the microphones, such as the first microphone 102, may be an always listening microphone (secondary microphone), while the other microphone, such as the second microphone 104, may be the primary microphone that is muted or unmuted by the device 100 to allow the user to participate in a teleconference. In addition to portable computing devices, the device 100 can correspond to other devices with multiple microphones, such as a speakerphone that may be found in conference rooms.

The device 100 depicts a processor 108 and a memory device 110 and, as an example of the device 100 performing its operations, the memory device 110 may include instructions 112-118 that are executable by the processor 108. Thus, memory device 110 can be said to store program instructions that, when executed by processor 108, implement the components of the device 100. The executable program instructions stored in the memory device 110 include, as an example, instructions to identify a user (112), instructions to compare voice characteristics (114), instructions to unmute the second microphone 104 (116), and instructions to mute the second microphone 104 (118).

Instructions to identify a user (112) represent program instructions that when executed by the processor 108 cause the device 100 to identify, via the first microphone 102, when a user registered to use the device 100 is speaking. As an example, identifying when a user registered to use the device 100 is speaking includes matching audio collected by the first microphone 102 with a pre-recorded voice pattern registered to the user. The pre-recorded voice pattern registered to the user, and any other voice patterns associated with other users that may be registered to use the device 100, may be stored in a database 106 on the device 100. However, the database 106 may also reside in a cloud service, particularly when the device 100 lacks abilities to accommodate the database 106 (e.g., low memory).

As an example, the process for obtaining the pre-recorded voice patterns for users registered to use the device 100 may be performed by the device 100 itself, or the cloud service. Benefits of using a cloud service include the ability for users to change their device without having to retrain their voice pattern, and having their voice pattern and voice characteristic stored in the cloud made accessible to other devices registered to the user. As an example of the device 100 being trained to obtain a pre-recorded voice pattern of the user, the device 100, via the first microphone 102, may learn the voice pattern associated with the user, register the voice pattern to the user, and store the voice pattern registered to the user in the database 106.

As an example of matching audio collected by the first microphone 102 with a pre-recorded voice pattern registered to a user, the device 100 may receive feeds from the first microphone 102, and extract voices from the feeds in order to perform voice pattern matching to identify when the registered user is speaking. Voice pattern matching for identifying when the registered user is speaking generally includes the steps of voice recording, pattern matching, and a decision. Although text dependent and text independent speaker recognition are available, text independent recognition may be desirable, where recognition is based on whatever words a user is saying. As an example of extracting voices from the feeds, the voice recording may first be cut into windows of equal length (e.g., frames). Then, with regards to pattern matching, the extracted frames may be compared against known speaker models/templates, such as the pre-recorded voice patterns of the users, resulting in a matching score that may quantify the similarity in between the voice recording and one of the known speaker models.

Instructions to compare voice characteristics (114) represent program instructions that when executed by the processor 108 cause the device 100, via the first microphone 102, to compare a voice characteristic of the identified user against a threshold value. In addition to training the device 100 to obtain a pre-recorded voice, pattern of the user, as described above, voice characteristics or speaking style of the user may be learned as well, particularly to determine when the user is actually speaking into the first microphone 102 and not, for example, having a side conversation that the user may not intend to be heard on the teleconference. Examples of voice characteristics that may be learned, in order to determine when the user is speaking into the first microphone 102, include, but are not limited to, the frequency of the voice (frequency response of the user), as well as attributes such as dynamics, pitch, duration, and loudness of the voice, or the sending loudness rating (SLR). As an example, when the voice recording is cut into frames, a combination of the above-mentioned voice characteristics may be analyzed in order to determine a threshold value when the user is likely speaking into the first microphone 102 and intending to being heard on the teleconference.

Instructions to unmute the second microphone 104 (116) represent program instructions that when executed by the processor 108 cause the device 100 to unmute the second microphone 104 when the voice characteristic of the user, collected by the first microphone 102, is greater than or equal to the threshold value determined during the training phase described above. By unmuting the second microphone 104, the user is able to participate in the teleconference by being heard by other participants. Instructions to mute the second microphone 104 (118) represent program instructions that when executed by the processor 108 cause the device 100 to mute the second microphone 104 when the voice characteristic of the user, collected by the first microphone 102, falls below the threshold value. By muting the second microphone 104, the user is muted from participating in the teleconference. By determining whether the voice characteristic of the user, collected by the first microphone 102, falls above or below the threshold value, the second microphone 104 may be automatically muted or unmuted.

As an example of the second microphone 104 being automatically muted, if the user is participating in the teleconference where there is background noise or a noisy environment, the second microphone 104 may be automatically muted when the user is not speaking. For example, the user may not be identified by the always listening microphone 102 and, thus, no voice characteristic may be collected either. However, if the user is having a side conversation while on the teleconference, although the user may be identified by the first microphone 102, the voice characteristic may fall below the threshold value, as the user is likely not speaking into the first microphone 102 or is speaking at a lower than normal voice. As a result, the second microphone 104 may remain muted, preventing the side conversation from being heard on the teleconference. However, when the user begins speaking into the first microphone 102, the voice characteristic may exceed the threshold value, automatically unmuting the second microphone 104, so that the user can participate in the teleconference. As an example, in an effort to improve when the second microphone 104 is muted or unmuted, the voice characteristic of the user may be learned over time, in order to improve detection of when the user is speaking into the first microphone 102.

Memory device 110 represents generally any number of memory components capable of storing instructions that can be executed by processor 108. Memory device 110 is non-transitory in the sense that it does not encompass a transitory signal but instead is made up of at least one memory component configured to store the relevant instructions. As a result, the memory device 110 may be a non-transitory computer-readable storage medium. Memory device 110 may be implemented in a single device or distributed across devices. Likewise, processor 108 represents any number of processors capable of executing instructions stored by memory device 110. Processor 108 may be integrated in a single device or distributed across devices. Further, memory device 110 may be fully or partially integrated in the same device as processor 108, or it may be separate but accessible to that device and processor 108.

In one example, the program instructions 112-118 can be part of an installation package that when installed can be executed by processor 108 to implement the components of the device 100. In this case, memory device 110 may be a portable medium such as a CD, DVD, or flash drive or a memory maintained by a server from which the installation package can be downloaded and installed. In another example, the program instructions may be part of an application or applications already installed. Here, memory device 110 can include integrated memory such as a hard drive, solid state drive, or the like.

Figure 2:
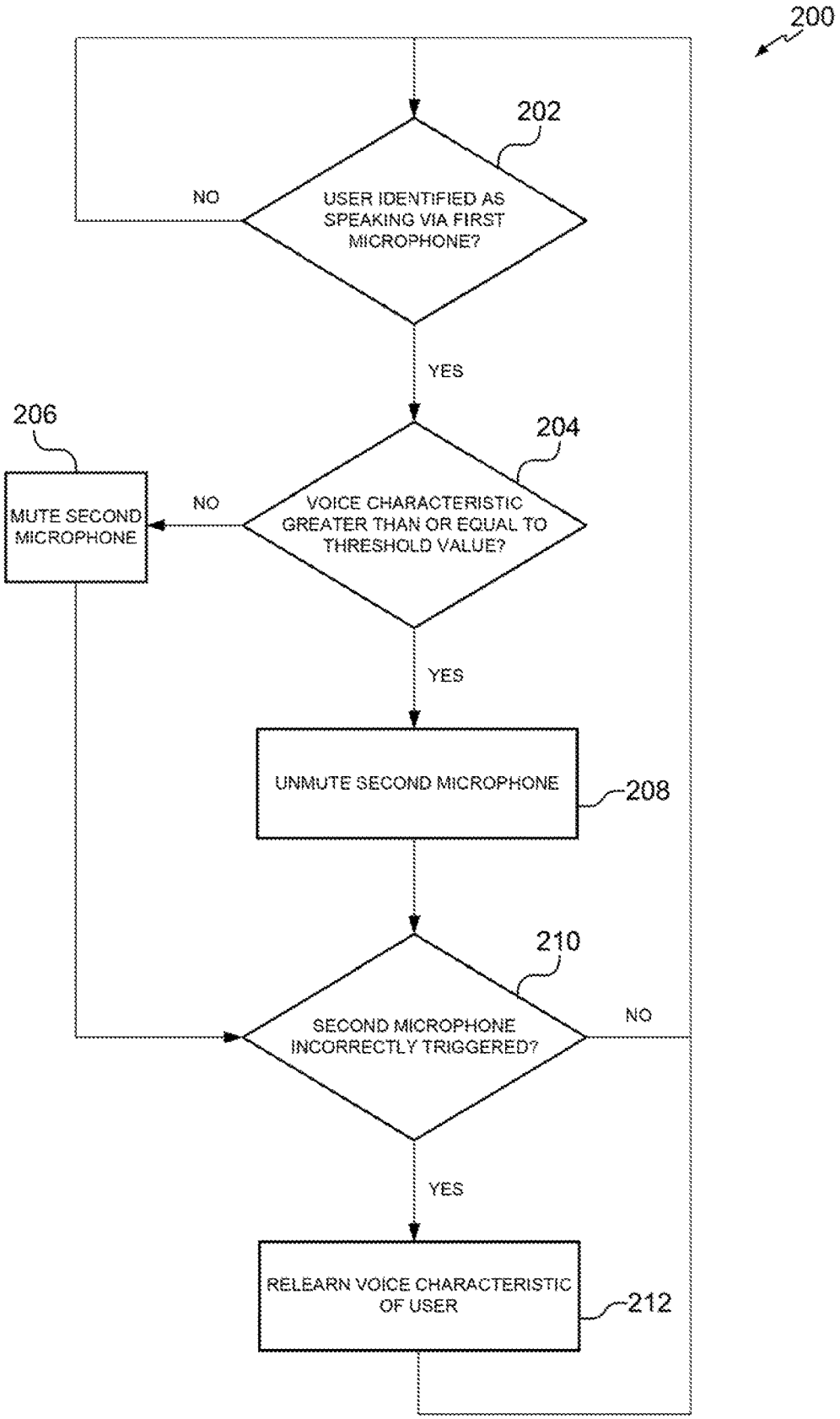
FIG. 2 illustrates a method at a device for automatically muting or unmuting a microphone of a device that allows a user to participate in a teleconference, according to an example.

FIG. 2 illustrates a method 200 at a device for automatically muting or unmuting a microphone of a device that allows a user to participate in a teleconference, according to an example. In discussing FIG. 2, reference may be made to the example device 100 illustrated in FIG. 1. Such reference is made to provide contextual examples and not to limit the manner in which method 200 depicted by FIG. 2 may be implemented.

Method 200 begins at 202, where the device determines whether a user registered to the device is identified as speaking via a first microphone of the device. As an example, identifying when a user registered to use the device is speaking includes matching audio collected by the first microphone with a pre-recorded voice pattern registered to the user. The pre-recorded voice pattern registered to the user may be stored in a database on the device, or stored in a cloud service. As an example of matching audio collected by the first microphone with a pre-recorded voice pattern registered to the user, the device may receive feeds from the first microphone, and extract voices from the feeds in order to perform voice pattern matching to identify when the registered user is speaking, as described above.

At 204, if the user is identified as speaking via the first microphone, the device determines whether a voice characteristic of the user is greater than or equal to a threshold value. As described above, in addition to learning the voice pattern of the user, voice characteristics or speaking style of the user may be learned as well, particularly to determine when the user is actually speaking into the first microphone and not, for example, having a side conversation that the user may not intend to be heard on the teleconference. Examples of voice characteristics that may be learned, in order to determine when the user is speaking into the first microphone, include, but are not limited to, the frequency of the voice (frequency response of the user), as well as attributes such as dynamics, pitch, duration, and loudness of the voice, or the sending loudness rating (SLR). After learning one or more of these characteristics, a threshold value may be computed for determining when the user is likely speaking into the first microphone.

At 206, if the voice characteristic falls below the threshold value, a second microphone of the device remains muted, preventing audio from user or its environment from being heard on the teleconference. As an example of the second microphone being automatically muted, if the user is participating in the teleconference where there is background noise or a noisy environment, the second microphone may be automatically muted when the user is not speaking. However, if the user is having a side conversation while on the teleconference, although the user may be identified by the first microphone, the voice characteristic may fall below the threshold value, as the user is likely not speaking into the first microphone or is speaking at a lower than normal voice. As a result, the second microphone may remain muted, preventing the side conversation from being heard on the teleconference.

At 208, if the voice characteristic is greater than or equal to the threshold value, the device automatically unmutes the second microphone, so that the user can participate in the teleconference. As an example, when the user begins speaking into the first microphone, the voice characteristic may exceed the threshold value, automatically unmuting the second microphone so that the user can participate in the teleconference.

At 210, the device may determine whether the second microphone was incorrectly triggered. For example, as the voice characteristic of the user is being learned, for example, to determine the threshold value for when the user is likely speaking into the first microphone, adjustments may have to be made to the threshold value if the second microphone is muted or unmuted at incorrect instances. For example, if the user is having a side conversation and the second microphone remains unmuted, the threshold value may have to be increased. Similarly, if the user is speaking into the first microphone, intending to participate in the teleconference, and the second microphone remains muted, the threshold value may have to be decreased. At 212, if the second microphone was incorrectly triggered, such changes may be made to the threshold value by relearning the voice characteristics of the user. As an example, in an effort to improve when the second microphone is muted or unmuted, the voice characteristic of the user may be learned over time, in order to improve detection of when the user is speaking into the first microphone, intending to participate in the teleconference.

Figure 3:
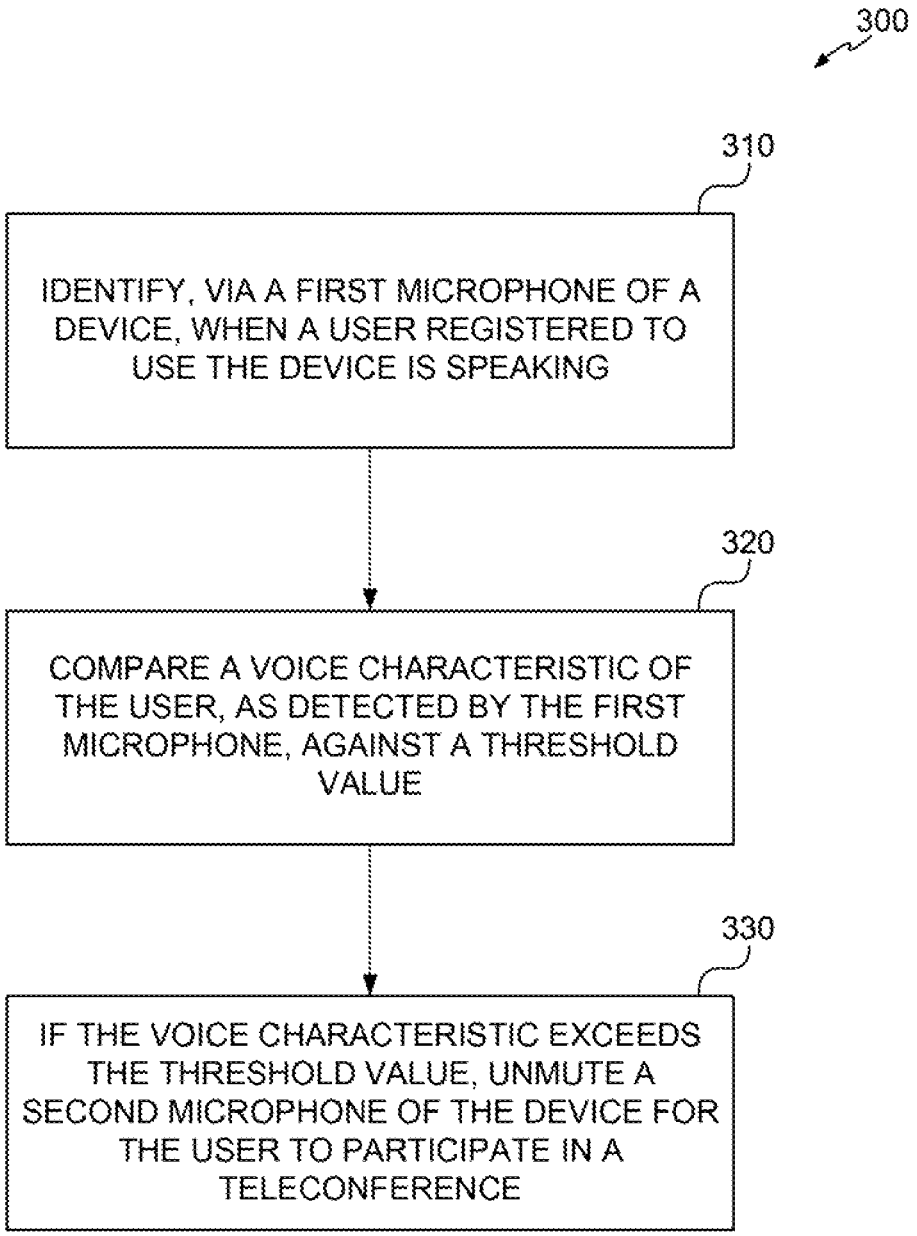
FIG. 3 is a flow diagram in accordance with an example of the present disclosure.

FIG. 3 is a flow diagram 300 of steps taken by a device to implement a method for determining whether a user of the device should be muted or unmuted from participating in a teleconference, according to an example. In discussing FIG. reference may be made to the example device 100 illustrated in FIG. 1. Such reference is made to provide contextual examples and not to limit the manner in which the method depicted by FIG. 3 may be implemented.

At 310, the device identifies, via a first microphone of the device, when the user registered to use the device is speaking. As an example, the first microphone may be an always listening microphone, or secondary microphone, for determining when a primary microphone should be enabled for the user to participate in the teleconference. As an example, identifying when the user is speaking includes matching audio collected by the first microphone with a voice pattern registered to the user (e.g., pre-recorded voice pattern described above).

At 320, the device compares a voice characteristic of the user, as detected by the first microphone, against a threshold value. Examples of voice characteristics that may be used, in order to determine when the user is speaking into the first microphone, include, but are not limited to, the frequency of the voice (frequency response of the user), as well as attributes such as dynamics, pitch, duration, and loudness of the voice, or the sending loudness rating (SLR).

At 330, if the voice characteristic exceeds the threshold value, the device unmutes the primary microphone, or a second microphone, for the user to participate in the teleconference. However, if the voice characteristic falls below the threshold value, the device mutes the second microphone, for the user to be muted from participating in the teleconference.

Although the flow diagram of FIG. 3 shows a specific order of execution, the order of execution may differ from that which is depicted. For example, the order of execution of two or more blocks or arrows may be scrambled relative to the order shown. Also, two or more blocks shown in succession may be executed concurrently or with partial concurrence. All such variations are within the scope of the present invention.

It is appreciated that examples described may include various components and features. It is also appreciated that numerous specific details are set forth to provide a thorough understanding of the examples. However, it is appreciated that the examples may be practiced without limitations to these specific details. In other instances, well known methods and structures may not be described in detail to avoid unnecessarily obscuring the description of the examples. Also, the examples may be used in combination with each other.

Reference in the specification to "an example" or similar language means that a particular feature, structure, or characteristic described in connection with the example is included in at least one example, but not necessarily in other examples. The various instances of the phrase "in one example" or similar phrases in various places in the specification are not necessarily all referring to the same example.

It is appreciated that the previous description of the disclosed examples provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

What is claimed is:

1. A method comprising:

identifying, via a first microphone of a device, when a user registered to use the device is speaking;

comparing a voice characteristic of the user, as detected by the first microphone, against a threshold value;

if the voice characteristic exceeds the threshold value, unmuting a second microphone of the device for the user to participate in a teleconference;

learning, via the first microphone, the voice characteristic of the user during the teleconference; and adjusting the threshold value of the voice characteristic over time based on voice characteristics determined during the teleconference.

2. The method of claim 1, comprising:

upon detecting when the voice characteristic is to fall below the threshold value, muting the second microphone, for the user to be muted from participating in the teleconference.

3. The method of claim 1, wherein identifying when the user registered to use the device is speaking comprises matching audio collected by the first microphone with a voice pattern registered to the user.

4. The method of claim 3, comprising:

training the device, via the first microphone, to identify a voice associated with the user, wherein the training comprises:

learning the voice pattern associated with the user;

registering the voice pattern to the user; and learning the voice characteristic of the user, when the user is to speak into the first microphone.

5. The method of claim 4, comprising:

uploading the voice pattern and voice characteristic of the user to a cloud service, that is accessible to other devices registered to the user.

6. The method of claim 1, wherein the voice characteristic of the user comprises a sending loudness rating (SLR) of the user or a frequency response of the user, used alone or in combination when comparing against the threshold value.

7. A device comprising:

a first microphone;

a second microphone;

a database; and a processor to:

learn, via the first microphone, a voice pattern associated with a user;

store the voice pattern in the database;

identify, via the first microphone, when the user is speaking, wherein identifying comprises matching audio collected by the first microphone with the stored voice pattern;

compare a voice characteristic of the user, as detected by the first microphone, against a threshold value;

if the voice characteristic exceeds the threshold value, unmute the second microphone for the user to participate in a teleconference;

learn, via the first microphone, additional voice characteristic of the user during the teleconference; and adjust the threshold value of the voice characteristic over time based on additional voice characteristics determined during the teleconference.

8. The device of claim 7, wherein, upon detecting when the voice characteristic is to fall below the threshold value, the processor is to mute the second microphone, for the user to be muted from participating in the teleconference.

9. The device of claim 7, wherein the processor to learn the voice pattern comprises learning the voice characteristic, when the user is to speak into the first microphone.

10. The device of claim 7, wherein the voice characteristic of the user comprises a sending loudness rating (SLR) of the user or a frequency response of the user, used alone or in combination when comparing against the threshold value.

11. A non-transitory computer-readable storage medium comprising program instructions which, when executed by a processor, to cause the processor to:

identify, via a first microphone of a device, when a user registered to use the device is speaking;

compare a voice characteristic of the user, as detected by the first microphone, against a threshold value;

if the voice characteristic is greater than or equal to the threshold value, unmute a second microphone of the device for the user to participate in a teleconference;

if the voice characteristic is less than the threshold value, mute the second microphone, for the user to be muted from participating in the teleconference;

learn, via the first microphone, additional voice characteristic of the user during the teleconference; and adjust the threshold value of the voice characteristic over time based on additional voice characteristics determined during the teleconference.

12. The non-transitory computer-readable storage medium of claim 11, wherein the instructions to cause the processor to identify when the user registered to use the device is speaking comprises instructions to cause the processor to match audio collected by the first microphone with a voice pattern registered to the user.

13. The non-transitory computer-readable storage medium of claim 11, wherein the voice characteristic of the user comprises a sending loudness rating (SLR) of the user or a frequency response of the user, used alone or in combination when comparing against the threshold value.

* * * * *